US007763162B2

(12) United States Patent
Strack

(10) Patent No.: US 7,763,162 B2
(45) **Date of Patent: *Jul. 27, 2010**

(54) METHOD FOR PROCESSING HYDROCARBON PYROLYSIS EFFLUENT

(75) Inventor: Robert David Strack, Houston, TX (US)

(73) Assignee: Exxonmobil Chemical Patents Inc., Houston, TX (US)

( * ) Notice: Subject to any disclaimer, the term of this patent is extended or adjusted under 35 U.S.C. 154(b) by 938 days.

This patent is subject to a terminal disclaimer.

(21) Appl. No.: 11/177,075

(22) Filed: Jul. 8, 2005

(65) Prior Publication Data

US 2007/0007169 A1 Jan. 11, 2007

(51) Int. Cl.

| | |
|---|---|
| ***C10G 9/16*** | (2006.01) |
| ***C10G 9/18*** | (2006.01) |
| ***B01J 10/00*** | (2006.01) |

(52) U.S. Cl. ..... 208/48 Q; 208/102; 208/103; 208/106; 422/129

(58) Field of Classification Search ..... 208/46, 208/48 R, 48 Q, 95, 100, 102, 103, 106, 129; 422/129

See application file for complete search history.

(56) References Cited

U.S. PATENT DOCUMENTS

| | | | | |
|---|---|---|---|---|
| 2,343,192 | A | 2/1944 | Kuhn | |
| 2,695,264 | A | 11/1954 | Taff et al. | |
| 2,901,418 | A | 8/1959 | Pappas | |
| 3,060,116 | A | 10/1962 | Hardin, Jr. et al. | |
| 3,498,906 | A | 3/1970 | Bogart et al. | |
| 3,529,030 | A | 9/1970 | Chin | |
| 3,593,968 | A | 7/1971 | Geddes | |
| 3,647,907 | A | 3/1972 | Sato et al. | |
| 3,676,519 | A | 7/1972 | Dorn et al. | |
| 3,907,661 | A | 9/1975 | Gwyn et al. | |
| 3,923,921 | A | 12/1975 | Kohfeldt | |
| 3,959,420 | A | 5/1976 | Geddes et al. | |
| 4,107,226 | A * | 8/1978 | Ennis et al. | 208/48 Q |

(Continued)

FOREIGN PATENT DOCUMENTS

| | | |
|---|---|---|
| EP | 0031609 | 7/1981 |

(Continued)

OTHER PUBLICATIONS

Lohr et al., "Steam-cracker Economy Keyed to Quenching," Oil Gas Journal, vol. 76 (No. 20), pp. 63-68, (1978).

(Continued)

*Primary Examiner*—Glenn Caldarola
*Assistant Examiner*—Randy Boyer

(57) ABSTRACT

A method is disclosed for treating the effluent from a hydrocarbon pyrolysis unit processing heavier than naphtha feeds to recover heat and remove tar therefrom. The method comprises passing the gaseous effluent to at least one primary heat exchanger, thereby cooling the gaseous effluent and generating superheated steam. Thereafter, the gaseous effluent is passed through at least one secondary heat exchanger having a heat exchange surface maintained at a temperature such that part of the gaseous effluent condenses to form a liquid coating on said surface, thereby further cooling the remainder of the gaseous effluent to a temperature at which tar, formed by the pyrolysis process, condenses. The condensed tar is then removed from the gaseous effluent in at least one knock-out drum. An apparatus for carrying out this method is also provided.

30 Claims, 4 Drawing Sheets

U.S. PATENT DOCUMENTS

| | | | | |
|---|---|---|---|---|
| 4,121,908 | A | | 10/1978 | Raab et al. |
| 4,150,716 | A | | 4/1979 | Ozaki et al. |
| 4,166,830 | A | | 9/1979 | Guth et al. |
| 4,233,137 | A | | 11/1980 | Ozaki et al. |
| 4,279,733 | A | | 7/1981 | Gwyn |
| 4,279,734 | A | * | 7/1981 | Gwyn ..... 208/48 Q |
| 4,420,343 | A | * | 12/1983 | Sliwka ..... 134/22.15 |
| 4,444,697 | A | | 4/1984 | Gater et al. |
| 4,446,003 | A | | 5/1984 | Burton et al. |
| 4,457,364 | A | | 7/1984 | DiNicolantonio et al. |
| 4,520,760 | A | | 6/1985 | Covell |
| 4,581,899 | A | | 4/1986 | von Klock et al. |
| 4,614,229 | A | | 9/1986 | Oldweiler |
| 4,702,818 | A | | 10/1987 | Oyamoto et al. |
| 4,945,978 | A | | 8/1990 | Herrmann |
| 5,092,981 | A | | 3/1992 | Russo |
| 5,107,921 | A | | 4/1992 | Tsai |
| 5,139,650 | A | | 8/1992 | Lenglet |
| 5,147,511 | A | | 9/1992 | Woebcke |
| 5,215,649 | A | | 6/1993 | Grenoble et al. |
| 5,271,827 | A | | 12/1993 | Woebcke |
| 5,294,347 | A | | 3/1994 | Byrne et al. |
| 5,324,486 | A | | 6/1994 | Russo |
| 5,579,831 | A | | 12/1996 | Brucher |
| 5,690,168 | A | | 11/1997 | Cizmar et al. |
| 5,756,055 | A | | 5/1998 | Kelly et al. |
| 6,148,908 | A | | 11/2000 | Brucher |
| 6,183,626 | B1 | | 2/2001 | Lenglet et al. |
| 6,271,431 | B1 | | 8/2001 | Busson et al. |
| 6,626,424 | B2 | | 9/2003 | Ngan et al. |
| 2003/0031612 | A1 | | 2/2003 | Raynal et al. |

FOREIGN PATENT DOCUMENTS

| | | | |
|---|---|---|---|
| EP | 205 205 | | 12/1986 |
| EP | 1 063 273 | | 12/2000 |
| GB | 1233795 | | 5/1971 |
| GB | 1309309 | | 3/1973 |
| GB | 1390382 | | 4/1975 |
| JP | 2001-40366 | | 2/2001 |
| JP | 2001-40366 | A * | 2/2001 |
| WO | WO 93/12200 | | 6/1993 |
| WO | WO 1997/13097 | | 4/1997 |
| WO | WO 00/56841 | | 9/2000 |
| WO | 2007/008424 | | 1/2007 |

OTHER PUBLICATIONS

Kister, Henry Z., *Distillation Design*, Chapter 6 "*Tray Design and Operation*", pp. 259-363, Chapter 8 "*Packing Design and Operation*", pp. 421-521, McGraw-Hill, Inc., Copyright © 1992.

Herrmann, H. & Burghardt, W., "*Latest Developments in Transfer Line Exchanger Design for Ethylene Plants*", Apr. 1994, Schmidt'sche-Heissdampf-Gesellschaft, pp. 193-228.

Mukherjee, R., "*Effectively Design Shell-and-Tube Heat Exchangers*", 94 Chem. Engr. Progress, pp. 21-37 (1998).

* cited by examiner

METHOD FOR PROCESSING HYDROCARBON PYROLYSIS EFFLUENT

CROSS-REFERENCE TO RELATED APPLICATIONS

The present application expressly incorporates by reference herein the entire disclosure of Ser. No. 11/177,975, entitled "METHOD FOR PROCESSING HYDROCARBON PYROLYSIS EFFLUENT", Ser. No. 11/178,158, entitled "METHOD FOR PROCESSING HYDROCARBON PYROLYSIS EFFLUENT", Ser. No. 11/777,125, entitled "METHOD FOR PROCESSING HYDROCARBON PYROLYSIS EFFLUENT", Ser. No. 11/178,037, entitled "METHOD FOR PROCESSING HYDROCARBON PYROLYSIS EFFLUENT", and Ser. No. 11/178,025, entitled "METHOD FOR PROCESSING HYDROCARBON PYROLYSIS EFFLUENT", which are being concurrently filed with the present application.

FIELD OF THE INVENTION

The present invention is directed to a method for processing the gaseous effluent from hydrocarbon pyrolysis units that can use heavy feeds, e.g., heavier than naphtha feeds.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules.

In the steam cracking process, it is desirable to maximize the recovery of useful heat from the process effluent stream exiting the cracking furnace. Effective recovery of this heat is one of the key elements of a steam cracker's energy efficiency.

The steam cracking process, however, also produces molecules which tend to combine to form high molecular weight materials known as tar. Tar is a high-boiling point, viscous, reactive material that, under certain conditions, can foul heat exchange equipment, rendering heat exchangers ineffective. The fouling propensity can be characterized by three temperature regimes.

Above the hydrocarbon dew point (the temperature at which the first drop of liquid condenses), the fouling tendency is relatively low. Vapor phase fouling is generally not severe, and there is no liquid present that could cause fouling. Appropriately designed transfer line heat exchangers are therefore capable of recovering heat in this regime with minimal fouling.

Between the hydrocarbon dew point and the temperature at which steam cracked tar is fully condensed, the fouling tendency is high. In this regime, the heaviest components in the stream condense. These components are believed to be sticky and/or viscous, causing them to adhere to surfaces. Furthermore, once this material adheres to a surface, it is subject to thermal degradation that hardens it and makes it more difficult to remove.

At or below the temperature at which steam cracked tar is fully condensed, the fouling tendency is relatively low. In this regime, the condensed material is fluid enough to flow readily at the conditions of the process, and fouling is generally not a serious problem.

One technique used to cool pyrolysis unit effluent and remove the resulting tar employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas or feedstocks heavier than naphthas, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly, in most commercial liquid crackers, cooling of the effluent from the cracking furnace is normally achieved using a system of heat exchangers, typically transfer line exchangers, a primary fractionator, and a water quench tower or indirect condenser. For a typical heavier than naphtha feedstock, the transfer line heat exchangers cool the process stream to about 593° C. (1100° F.), efficiently generating super-high pressure steam which can be used elsewhere in the process. The primary fractionator is normally used to condense and separate the tar from the lighter liquid fraction, known as pyrolysis gasoline, and to recover the heat between about 93° and about 316° C. (200° F. to 600° F.). The water quench tower or indirect condenser further cools the gas stream exiting the primary fractionator to about 40° C. (100° F.) to condense the bulk of the dilution steam present and to separate pyrolysis gasoline from the gaseous olefinic product, which is then sent to a compressor.

The present invention seeks to provide a simplified method for treating pyrolysis unit effluent, particularly the effluent from the steam cracking of hydrocarbonaceous feeds that are heavier than naphthas. Heavy feed cracking is often more economically advantageous than naphtha cracking, but in the past it suffered from poor energy efficiency and higher investment requirements. The present invention optimizes recovery of the useful heat energy resulting from heavy feed steam cracking without fouling of the cooling equipment. This invention can also obviate the need for a primary fractionator tower and its ancillary equipment.

Heavy feed steam cracking effluent can be treated by using a primary transfer line heat exchanger generating high pressure steam to initially cool the furnace effluent. The surfaces of heat exchanger tubes must operate above the hydrocarbon dew point to avoid rapid fouling, typically an average bulk outlet temperature of about 593° C. (about 1100° F.) for a heavy gas oil feedstock. Additional cooling can be provided by directly injecting a quench liquid such as tar or distillate to immediately cool the stream without fouling. Alternatively, the pyrolysis furnace effluent can be directly quenched, e.g., with distillate, which also avoids fouling. However, the former cooling method suffers from the drawback that only a fraction of the heat is recovered in a primary transfer line exchanger; moreover, in both methods, remaining heat removed by direct quenching is recovered at a lower temperature where it is less valuable. Furthermore, additional investment is required in the downstream primary fractionator where low level heat is ultimately removed, and in offsite boilers which must generate the remaining high pressure steam required by the steam cracking plant.

Accordingly, it would be desirable to recover useful heat from steam cracking furnace effluent in the absence of rapid fouling and absent direct quenching.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone, and a separating zone.

Lohr et al., "Steam-cracker Economy Keyed to Quenching," Oil & Gas Journal, Vol. 76 (No. 20), pp. 63-68, (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent from steam cracking, comprising a primary transfer line heat exchanger which functions to rapidly cool furnace effluent and to generate high temperature steam and a secondary transfer line heat exchanger which functions to cool the furnace effluent to as low a temperature as possible consistent with efficient primary fractionator or quench tower performance and to generate medium- to low-pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line heat exchangers and then quenching the effluent with liquid water so that the effluent is cooled to a temperature in the range of 105° C. to 130° C. (221° F. to 266° F.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

SUMMARY OF THE INVENTION

In one aspect, the present invention is directed to a method for treating gaseous effluent from a hydrocarbon pyrolysis process unit, the method comprising: (a) passing the gaseous effluent derived from pyrolysis of a feed heavier than naphtha through at least one primary heat exchanger, thereby cooling the gaseous effluent to a temperature above its dew point and generating from saturated steam having a temperature of less than about 288° C. (550° F.), superheated steam having a temperature of at least about 399° C. (750° F.) and a pressure of no greater than about 6310 kPa (900 psig); (b) passing the gaseous effluent from step (a) through at least one secondary heat exchanger having a heat exchange surface maintained at a temperature such that part of the gaseous effluent condenses to form in situ a liquid coating on the surface, thereby further cooling the gaseous effluent to a temperature at which at least a portion of the tar, formed by the pyrolysis process, in the gaseous effluent condenses; and (c) removing the condensed tar from the gaseous effluent.

In an embodiment of this aspect, the gaseous effluent derived from the pyrolysis has a temperature ranging from about 704° to about 927° C. (about 1300° to about 1700° F.), and the steam is superheated in the primary heat exchanger to a temperature ranging from about 399° to about 704° C. (about 750° to about 1300° F.) and a pressure ranging from about 2170 to about 6310 kPa (300 to 900 psig).

In another embodiment, the steam is superheated to a temperature ranging from about 482° to about 538° C. (900° to 1000° F.) and a pressure ranging from about 3206 to about 5275 kPa (450 to 750 psig).

In yet another embodiment, the heat exchange surface is maintained at a temperature below that at which tar condenses, e.g., a temperature below about 316° C. (600° F.), say, a temperature between about 149° C. (300° F.) and 260° C. (500° F.), say a temperature of about 213° C. (415° F.).

In still another embodiment, the heat exchange surface is disposed substantially vertically and is maintained at the temperature by indirect heat exchange with a heat transfer medium which flows downwards through the at least one secondary heat exchanger.

In yet still another embodiment, the heat exchange surface is maintained at the temperature by indirect heat exchange with water and the water heated in the at least one secondary heat exchanger is used as a heat exchange medium in the primary heat exchanger.

In still another embodiment, step (c) includes passing the effluent from the secondary heat exchanger to a tar knock-out drum.

In still yet another embodiment, the method includes step (d), further cooling the effluent remaining after removal of the tar in step (c) to condense a pyrolysis gasoline fraction therefrom and reduce the temperature of the effluent to less than about 100° C. (212° F.). Step (d) can be effected by direct quenching with water, or alternately, by indirect heat exchange.

In another embodiment, the gaseous effluent is produced by pyrolysis of a hydrocarbon feed having a final boiling point greater than about 180° C. (356° F.), typically, from about 260° to about 538° C. (about 500° to about 1000° F.), say, from about 343° to about 510° C. (about 650° to about 950° F.).

In a further aspect, the invention resides in a method for treating gaseous effluent from a hydrocarbon pyrolysis process unit, the method comprising: (a) passing the gaseous effluent derived from pyrolysis of a feed heavier than naphtha through at least one primary heat exchanger, thereby cooling the gaseous effluent to a temperature above its dew point and generating from saturated steam having a temperature of less than about 288° C. (550° F.), superheated steam having a temperature of at least about 399° C. (750° F.) and a pressure no greater than about 6310 kPa (900 psig); (b) passing the gaseous effluent from step (a) through at least one secondary heat exchanger having a heat exchange surface maintained at a temperature such that part of the gaseous effluent condenses to form in situ a liquid coating on the surface, thereby further cooling the gaseous effluent to a temperature at which tar, formed by the pyrolysis process, condenses; (c) passing the gaseous effluent from step (b) through at least one knock-out drum, where the condensed tar separates from the gaseous effluent; and then (d) reducing the temperature of the gaseous effluent to less than about 100° C. (212° F.).

In one embodiment of this aspect of the invention, the heat exchange surface is maintained at the temperature by indirect heat exchange with water and the water heated in the at least one secondary heat exchanger is used as a heat exchange medium in the primary heat exchanger.

In another embodiment of this aspect, step (d) reduces the temperature of the gaseous effluent to about 20° to about 50° C. (68° to 122° F.).

In still another embodiment of this aspect, step (d) also includes condensing and separating a pyrolysis gasoline fraction from the effluent.

In yet a further aspect of the invention, the invention resides in a hydrocarbon cracking apparatus comprising: (a) a reactor for pyrolyzing a hydrocarbon feedstock, the reactor having an outlet through which gaseous pyrolysis effluent can exit the reactor; (b) at least one primary heat exchanger connected to and downstream of the reactor outlet for cooling the gaseous effluent, the primary heat exchanger comprising (i) a heat transfer exchange medium inlet receiving saturated steam having a temperature ranging from about 214° to about 277° C. (417° to 530° F.), and a pressure of less than about 6310 kPa (900 psig) and (ii) a heat transfer exchange medium outlet providing superheated steam having a temperature of at least about 399° C. (750° F.) and a pressure of no greater than about 6310 kPa (900 psig); (c) at least one secondary heat exchanger comprising (i) a heat transfer exchange medium inlet receiving water at a temperature of less than about 260° C. (500° F.) and a pressure of less than about 6998 kPa (1000 psig) and (ii) a heat transfer exchange medium outlet providing saturated steam having a temperature ranging from about 214° to about 277° C. (417° to about 530° F.), and a pressure of less than about 6310 kPa (900 psig), the secondary heat exchanger being connected to and downstream of the at least one primary heat exchanger for further cooling the gaseous effluent, the at least one secondary heat exchanger having a heat exchange surface which is maintained, in use, at a temperature such that part of the gaseous effluent condenses to form in situ a liquid coating on the surface, thereby cooling the remainder of the gaseous effluent to a temperature at which tar, formed during pyrolysis, condenses; and (d) means for separating condensed tar from the gaseous effluent.

In one embodiment of this aspect of the invention, the at least one secondary heat exchanger includes an inlet for the gaseous effluent and the inlet is thermally insulated from the heat exchange surface to maintain the inlet at a temperature above that at which tar in the gaseous effluent condenses. Typically, the at least one secondary heat exchanger is a tube-in-shell or tube-in-tube heat exchanger.

In another embodiment of this aspect, the apparatus further includes a decoking system having an inlet for a decoking medium and an outlet for coke, wherein the primary and secondary heat exchangers can be connected to the decoking system such that the decoking medium passes through the at least one primary heat exchanger and then the at least one secondary heat exchanger before flowing to the outlet.

In yet another embodiment of this aspect, the primary and secondary heat exchangers comprise heat exchange tubes and the or each heat exchange tube of the secondary heat exchanger has an internal diameter equal to or greater than that of the or each heat exchange tube of the primary heat exchanger.

In still another embodiment of this aspect, the means (d) is a tar knock-out drum.

DETAILED DESCRIPTION OF THE EMBODIMENTS

Figure 1:
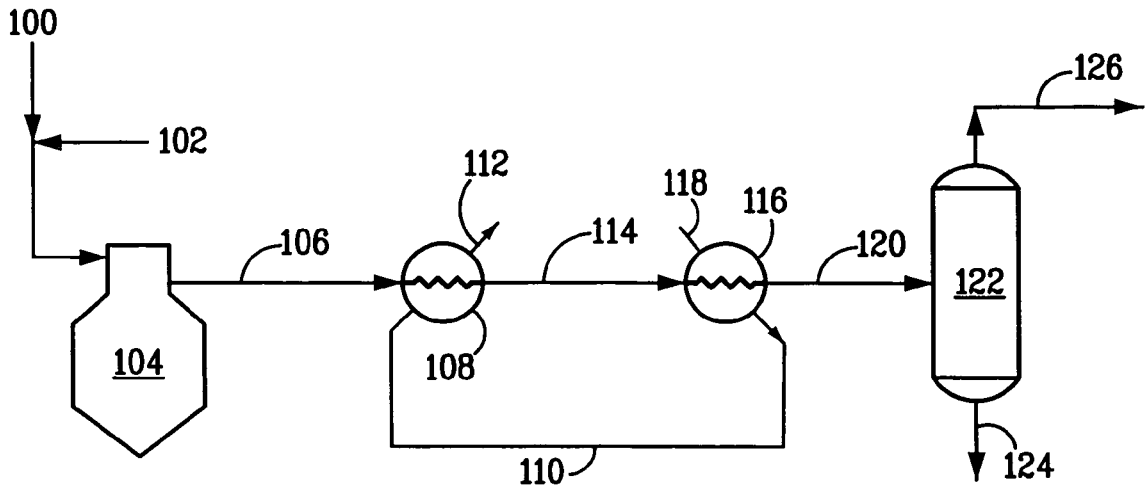
FIG. 1 is a schematic flow diagram of a method according to one example of the present invention of treating the gaseous effluent from the cracking of a feed heavier than naphtha.

The present invention provides a low cost way of treating the gaseous effluent stream from a hydrocarbon pyrolysis reactor so as to remove and recover heat therefrom and to separate $C_5$+ hydrocarbons from the desired $C_2$-$C_4$ olefins in the effluent, while minimizing fouling.

Typically, the effluent used in the method of the invention is produced by pyrolysis of a hydrocarbon feed boiling with a final boiling point in a temperature range from above about 180° C., such as feeds heavier than naphtha. Such feeds include those boiling in the range from about 93° to about 649° C. (from about 200° to about 1200° F.), say, from about from about 204° to about 510° C. (from about 400° to about 950° F.). Typical heavier than naphtha feeds can include heavy condensates, gas oils, kerosene, hydrocrackates, crude oils, and/or crude oil fractions. The temperature of the gaseous effluent at the outlet from the pyrolysis reactor is normally in the range of from about 760° C. to about 930° C. (1400° F. to 1706° F.) and the invention provides a method of cooling the effluent to a temperature at which the desired $C_2$-$C_4$ olefins can be compressed efficiently, generally less than about 100° C. (212° F.), for example less than about 75° C. (167° F.), such as less than about 60° C. (140° F.) and typically from about 20° to about 50° C. (68° to about 122° F.).

In particular, the present invention relates to a method for treating the gaseous effluent from the heavy feed cracking unit, which method comprises passing the effluent through at least one primary heat exchanger, which is capable of recovering heat from the effluent down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service. The primary heat exchanger cools the process stream to a temperature between about 340° C. and about 650° C. (644° and 1202° F.), such as about 371° C. (700° F.), using saturated steam as the cooling medium and generates superheated steam, typically at about 4240 kPa (600 psig).

On leaving the primary heat exchanger, the cooled gaseous effluent is still at a temperature above the hydrocarbon dew point (the temperature at which the first drop of liquid condenses) of the effluent. For a typical heavy feed under certain cracking conditions, the hydrocarbon dew point of the effluent stream ranges from about 343° to about 649° C. (650° to 1200° F.), say, from about 399° to about 593° C. (750° to 1100° F.). Above the hydrocarbon dew point, the fouling tendency is relatively low, i.e., vapor phase fouling is generally not severe, and there is no liquid present that could cause fouling. Tar condenses from such heavy feeds at a temperature ranging from about 204° to about 343° C. (400° to 650° F.), say, from about 232° to about 316° C. (450° to 600° F.).

After leaving the primary heat exchanger, the effluent is then passed to at least one secondary heat exchanger which is designed and operated such that it includes a heat exchange surface cool enough to condense part of the effluent and generate a liquid hydrocarbon film at the heat exchange surface. The liquid film is generated in situ and is preferably at or below the temperature at which tar is fully condensed, typically at about 204° C. to about 343° C. (400° to 650° F.), such as at about 260° C. (500° F.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary heat exchanger must cool the process stream continuously to the temperature at which tar is produced. If the cooling is stopped before this point, fouling is likely to occur because the process stream would still be in the fouling regime.

The invention will now be more particularly described with reference to the accompanying drawings.

Figure 2:
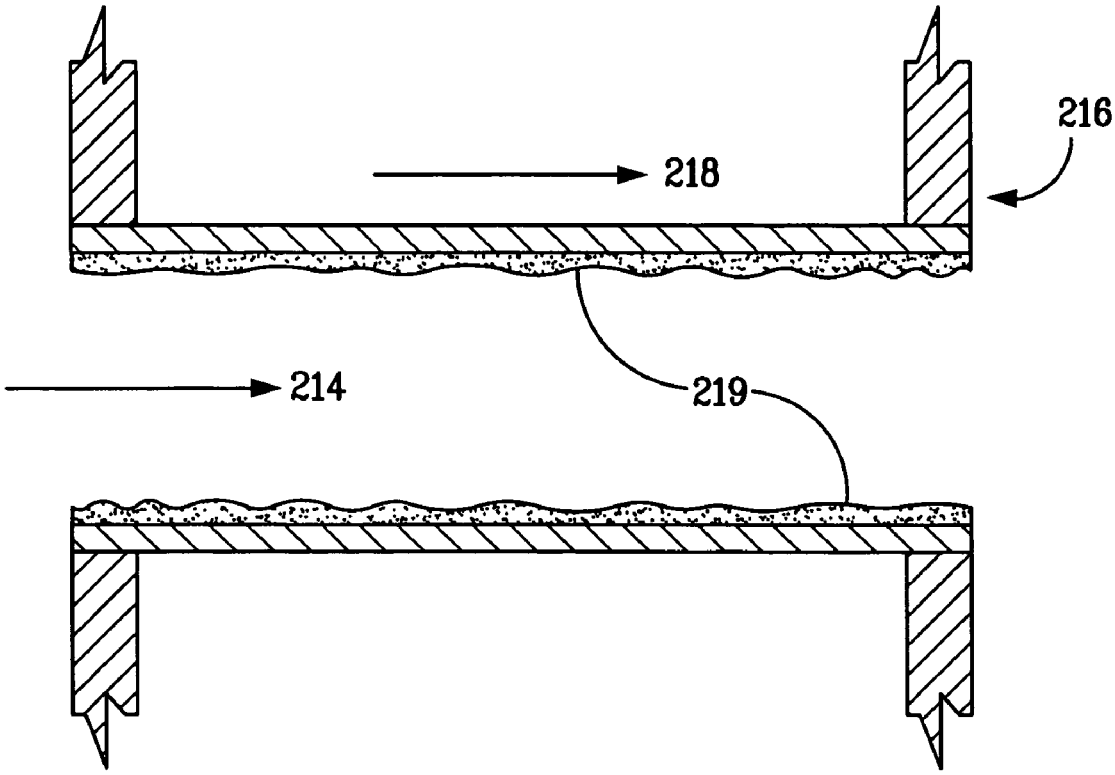
FIG. 2 is a sectional view of one tube of a wet transfer line heat exchanger employed in the method shown in FIG. 1.

Referring to FIGS. 1 and 2, in the method shown which recovers heat from furnace effluent in two stages to provide superheated steam, a hydrocarbon feed 100 comprising heavy gas oil obtained from Tapis crude oil and dilution steam 102 is fed to a steam cracking reactor 104 where the hydrocarbon feed is heated to cause thermal decomposition of the feed to produce lower molecular weight hydrocarbons, such as $C_2$-$C_4$ olefins. The pyrolysis process in the steam cracking reactor 104 also produces some tar.

Gaseous pyrolysis effluent 106 exiting the steam cracking furnace 104 initially passes through at least one primary transfer line heat exchanger 108 which cools the effluent from an inlet temperature ranging from about 704° C. to about 927° C. (1300° F. to 1700° F.), say, from about 760° C. to about 871° C. (1400° F. to 1600° F.), e.g., about 816° C. (about 1500° F.), to an outlet temperature ranging from about 316° C. to about 704° C. (about 600° F. to about 1300° F.), say, from about 371° C. to about 649° C. (700° F. to 1200° F.), e.g., about 593° C. (1100° F.). The primary heat exchanger 108 comprises a steam inlet 110 for introducing high pressure steam ranging from about 2172 kPa to about 6310 kPa (300 to 900 psig), say, about 4240 kPa (600 psig), and having a temperature ranging from about 216° C. to about 279° C. (420° F. to 535° F.), e.g., about 254° C. (490° F.). High pressure, superheated steam is taken from steam outlet 112 and has a temperature ranging from about 371° C. to about 649° C. (700° F. to 1200° F.), say, from about 427° C. to about 593° C. (800° F. to 1100° F.), e.g., about 510° C. (950° F.). Typically, the pressure is substantially unchanged from the steam provided through steam inlet 110. After leaving the primary transfer line heat exchanger 108, the cooled effluent stream 114 is then fed to at least one secondary heat exchanger 116, where the effluent is cooled to a temperature ranging from about 121° C. to about 343° C. (250° F. to 650° F.), say, from about 149° C. to about 316° C. (300° F. to 600° F.), e.g., about 232° C. (450° F.) on the tube side of the secondary heat exchanger 116 while boiler feed water 118 is preheated and vaporized on the shell side of the secondary heat exchanger 116. In this way, the heat exchange surfaces of the secondary heat exchanger 116 are cool enough to generate a liquid film in situ at the surface of the tube, the liquid film resulting from condensation of the gaseous effluent.

FIG. 2 depicts co-current flow of the effluent 214 (corresponding to effluent stream 114 in FIG. 1, etc.) and boiler feed water 218 to minimize the temperature of the liquid film 219 at the process side inlet; other arrangements of flow are possible, including countercurrent flow. Because heat transfer is rapid between the boiler feed water and the tube metal, the tube metal is just slightly hotter than the boiler feed water 218 at any point in the heat exchanger 216. Heat transfer is also rapid between the tube metal and the liquid film 219 on the process side, and therefore the film temperature is just slightly hotter than the tube metal temperature at any point in heat exchanger 216. Along the entire length of the heat exchanger 216, the film temperature is below the temperature at which tar is fully condensed, say, about 260° C. (500° F.). This ensures that the film is completely fluid, and thus fouling is avoided.

Preheating high pressure boiler feed water in the secondary heat exchanger 116 (or 216) is one of the most efficient uses of the heat generated in the pyrolysis unit. Following deaeration, boiler feed water is typically available at a temperature ranging from about 104° C. to about 149° C. (220° F. to 300° F.), say, from about 116° C. to about 138° C. (240° F. to 280° F.), e.g., about 132° C. (270° F.). Boiler feed water from the deaerator can therefore be preheated in the secondary transfer line heat exchanger 116 and thereafter sent to the at least one primary transfer line heat exchanger 108 via 110. All of the heat used to preheat boiler feed water will increase high pressure steam production.

On leaving the heat exchanger 116, the cooled gaseous effluent 120 is at a temperature where the tar condenses and is then passed into at least one tar knock-out drum 122 where the effluent is separated into a tar and coke fraction 124 and a gaseous fraction 126.

The hardware for the secondary heat exchanger 116 may be similar to that of a secondary transfer line exchanger often used in gas cracking service. A shell and tube exchanger can be used. The process stream can be cooled on the tube side in a single pass, fixed tubesheet arrangement. A relatively large tube diameter would allow coke produced upstream to pass through the exchanger without plugging. The design of the heat exchanger 116 may be arranged to minimize the temperature and maximize thickness of the liquid film 219, for example, by adding fins to the outside surface of the heat exchanger tubes. Boiler feed water could be preheated on the shell side in a single pass arrangement. Alternatively, the shell side and tube side services could be switched. Either co-current or counter-current flow could be used, provided that the film temperature is kept low enough along the length of the exchanger.

Figure 3:
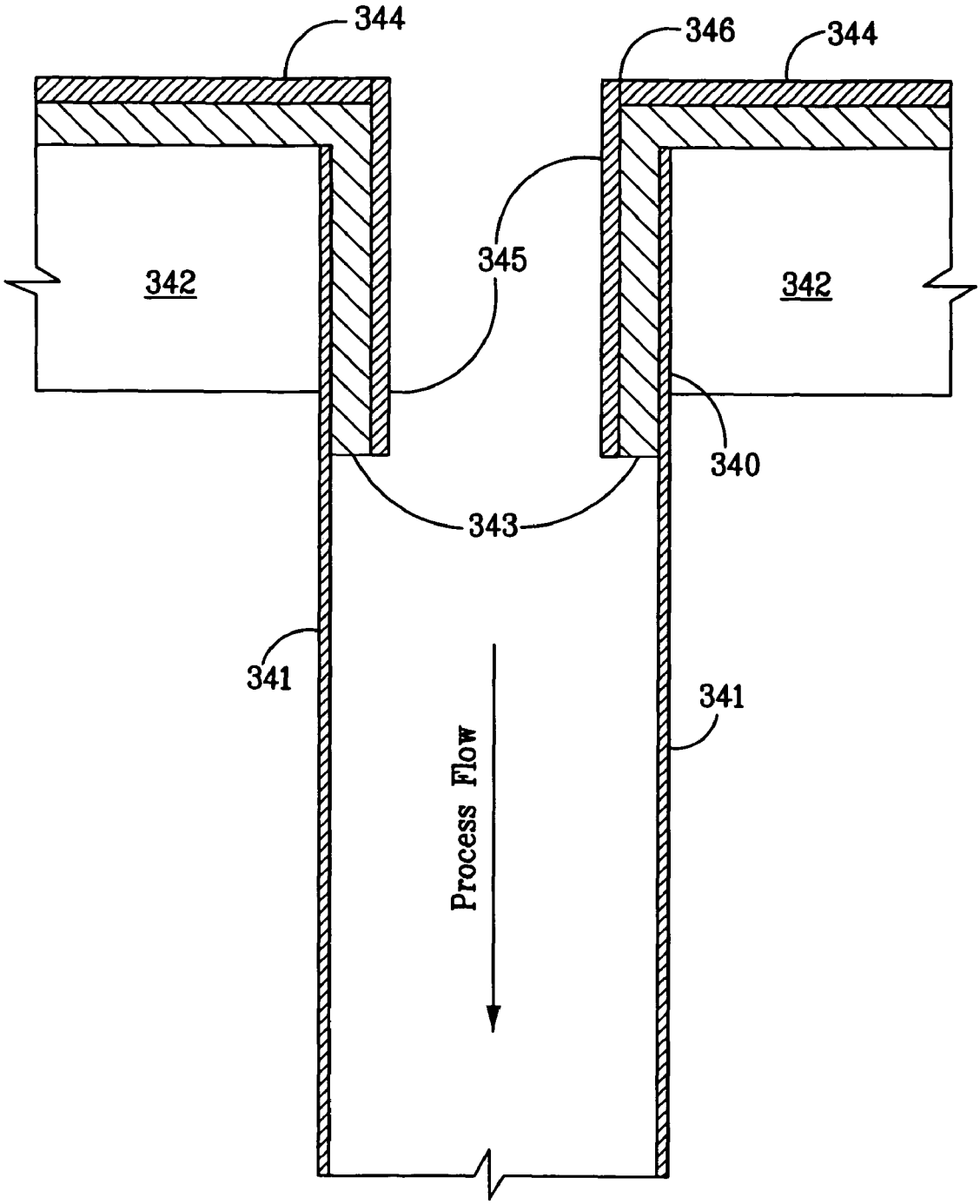
FIG. 3 is a sectional view of the inlet transition piece of a shell-and-tube wet transfer line heat exchanger employed in the method shown in FIG. 1.

For example, the inlet transition piece of a suitable shell-and-tube wet transfer line exchanger is shown in FIG. 3. A heat exchanger tube 341 is fixed in an aperture 340 in a tubesheet 342. A tube insert or ferrule 345 is fixed in an aperture 346 in a false tubesheet 344 positioned adjacent tubesheet 342 such that the ferrule 345 extends into the heat exchanger tube 341 with a thermally insulating material 343 being placed between the tubesheet 342 and the false tubesheet 344 and between the heat exchanger tube 341 and the ferrule 345. With this arrangement, the false tubesheet 344 and ferrule 345 operate at a temperature very close to the process inlet temperature while the heat exchanger tube 341 operates at a temperature very close to that of the cooling medium. Accordingly, little fouling will occur on the false tubesheet 344 and the ferrule 345 because they operate above the dew point of the pyrolysis effluent. Similarly, little fouling will occur on the surface of the heat exchanger tube 341 because it operates below the temperature at which the tar fully condenses. This arrangement provides a very sharp transition in surface temperatures to avoid the fouling temperature regime between the hydrocarbon dew point and the temperature at which the tar fully condenses.

Alternatively, the hardware for the secondary transfer line exchanger may be similar to that of a close coupled primary transfer line exchanger. A tube-in-tube exchanger could be used. The process stream could be cooled in the inner tube. A relatively large inner tube diameter would allow coke produced upstream to pass through the exchanger without plugging. Boiler feed water could be preheated in the annulus between the outer and inner tubes. Either co-current or counter-current flow could be used, provided that the film temperature is kept low enough along the length of the exchanger.

Figure 4:
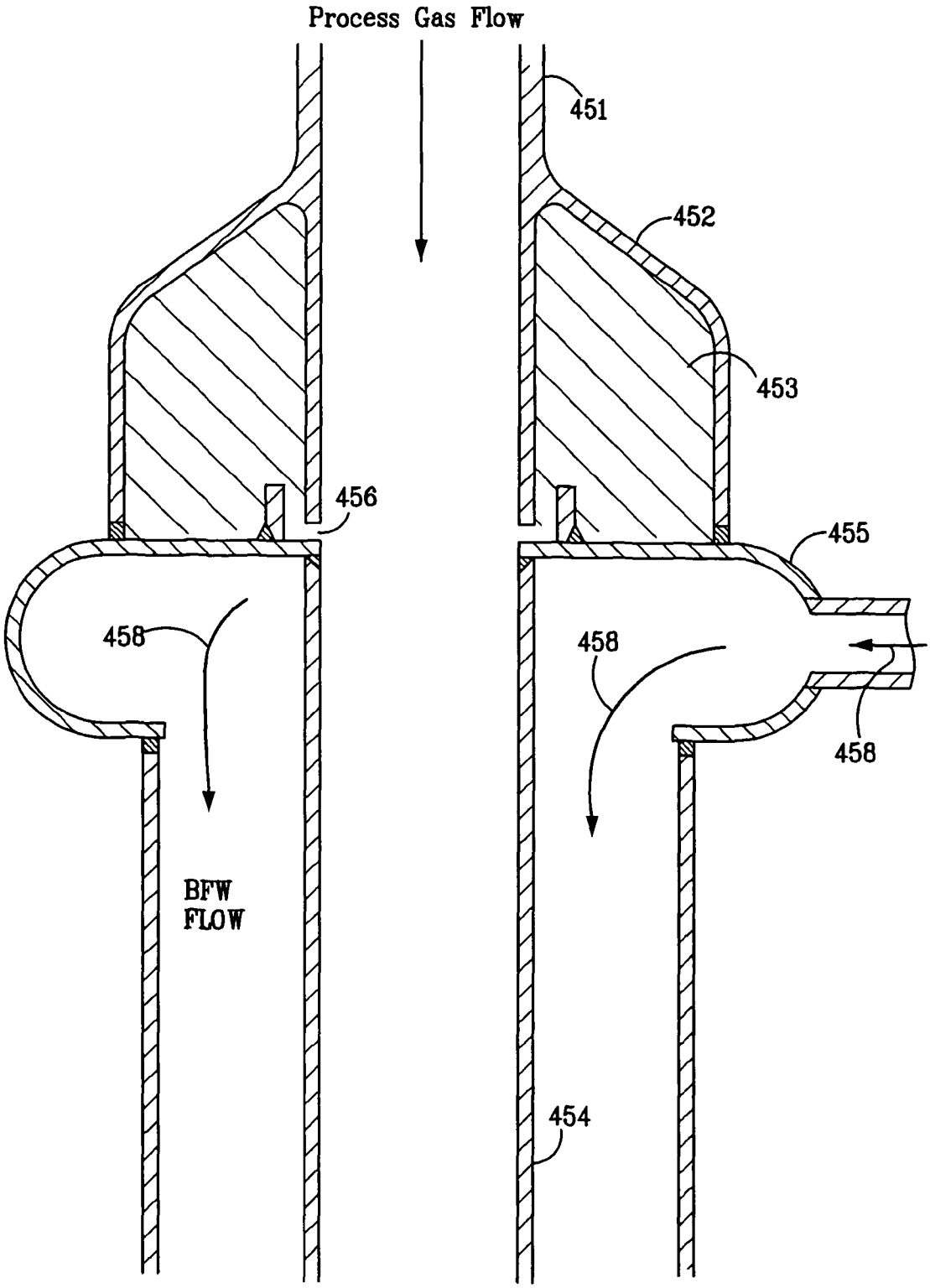
FIG. 4 is a sectional view of the inlet transition piece of a tube-in-tube wet transfer line heat exchanger employed in the method shown in FIG. 1.

For example, the inlet transition piece of a suitable tube-in-tube wet transfer line exchanger is shown in FIG. 4. An exchanger inlet line 451 is attached to swage 452 which is attached to a boiler feed water inlet chamber 455. Insulating material 453 fills the annular space between the exchanger inlet line 451, swage 452, and boiler feed water inlet chamber 455. Heat exchanger tube 454 is attached to boiler feed water inlet chamber 455 which receives boiler feed water 458 such that there is a small gap 456 between the end of inlet line 451 and the beginning of heat exchanger tube 454 to allow for thermal expansion. A similar arrangement, although incorporating a wye-piece in the process gas flow piping, is described in U.S. Pat. No. 4,457,364, whose entire contents are incorporated herein by reference. The entire exchanger inlet line 451 operates at a temperature very close to the process temperature while the heat exchanger tube 454 operates at a temperature very close to that of the cooling medium. Accordingly, little fouling will occur on the surface of the exchanger inlet line 451 because it operates above the dew point of the pyrolysis effluent. Similarly, little fouling will occur on the heat exchanger tube 454 because it operates below the temperature at which the tar fully condenses. Again this arrangement provides a very sharp transition in surface temperatures to avoid the fouling temperature regime between the hydrocarbon dew point and the temperature at which the tar fully condenses.

The secondary exchanger may be oriented such that the process flow is either substantially horizontal, substantially vertical upflow, or, preferably, substantially vertical downflow. A substantially vertical downflow system helps ensure that the in situ liquid film remains fairly uniform over the entire inside surface of the heat exchanger tube, thereby minimizing fouling. In contrast, in a horizontal orientation the liquid film will tend to be thicker at the bottom of the heat exchanger tube and thinner at the top because of the effect of gravity. In a vertical upflow arrangement, the liquid film may tend to separate from the tube wall as gravity tends to pull the liquid film downward. Another practical reason favoring a substantially downflow orientation is that the inlet stream exiting the primary transfer line exchanger is often located high up in the furnace structure, while the outlet stream is desired at a lower elevation. A downward flow secondary heat exchanger would naturally provide this transition in elevation for the stream.

The secondary heat exchanger may be designed to allow decoking of the exchanger using steam or a mixture of steam and air in conjunction with the furnace decoking system. When the furnace is decoked, using either steam or a mixture of steam and air, the furnace effluent would first pass through the primary heat exchanger and then through the secondary heat exchanger prior to being disposed of to the decoke effluent system. With this feature, it is advantageous for the inside diameter of the secondary transfer line exchanger tubes to be greater than or equal to the inside diameter of the primary transfer line exchanger tubes. This ensures that any coke present in the effluent of the primary transfer line exchanger will readily pass through the secondary transfer line exchanger tube without causing any restrictions.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A method for treating gaseous effluent from a hydrocarbon pyrolysis process unit, the method comprising:

(a) passing said gaseous effluent derived from pyrolysis of a feed heavier than naphtha through at least one primary heat exchanger, thereby cooling said gaseous effluent to a temperature above its dew point and generating from saturated steam having a temperature of less than about 288° C. (550° F.), superheated steam having a temperature of at least about 399° C. (750° F.) and a pressure of no greater than about 6310 kPa (900 psig);

(b) passing said gaseous effluent from step (a) through at least one secondary heat exchanger having a heat exchange surface maintained at a temperature such that part of said gaseous effluent condenses to form a liquid coating on the surface, thereby further cooling the gaseous effluent to a temperature at which at least a portion of the tar, formed by the pyrolysis process, in the gaseous effluent condenses; and (c) removing said condensed tar from said gaseous effluent;

said method being carried out in the absence of direct quenching.

2. The method of claim 1, wherein the gaseous effluent derived from said pyrolysis has a temperature ranging from about 704° to about 927° C. (1300° to about 1700° F.), and said steam is superheated in said primary heat exchanger to a temperature ranging from about 399° to about 704° C. (750° to 1300° F.) and a pressure ranging from about 2170 to about 6310 kPa (300 to 900 psig).

3. The method of claim 1, wherein said steam is superheated to a temperature ranging from about 482° to about 538° C. (900° to 1000° F.) and a pressure ranging from about 3206 to about 5275 kPa (450 to750 psig).

4. The method of claim 1, wherein said heat exchange surface is maintained at a temperature below that at which tar condenses.

5. The method of claim 1, wherein said heat exchange surface is maintained at a temperature below about 316° C. (600° F.).

6. The method of claim 1, wherein said heat exchange surface is maintained at a temperature between about 149° C. (300° F.) and 260° C. (500° F.).

7. The method of claim 1, wherein said heat exchange surface is disposed substantially vertically and is maintained at said temperature by indirect heat exchange with a heat transfer medium which flows downwards through said at least one secondary heat exchanger.

8. The method of claim 1, wherein said heat exchange surface is maintained at said temperature by indirect heat exchange with water and the water heated in the at least one secondary heat exchanger is used as a heat exchange medium in said primary heat exchanger.

9. The method of claim 1, wherein step (c) includes passing the effluent from the secondary heat exchanger to a tar knock-out drum.

10. The method of claim 1, and including (d) further cooling the effluent remaining after removal of the tar in step (c) to condense a pyrolysis gasoline fraction therefrom and reduce the temperature of the effluent to less than about 100° C. (212° F.).

11. The method of claim 10, wherein step (d) is effected by indirect heat exchange.

12. The method of claim 1, wherein said gaseous effluent is produced by pyrolysis of a hydrocarbon feed boiling at a temperature greater than about 180° C. (356° F.).

13. The method of claim 1, wherein said gaseous effluent is produced by pyrolysis of a hydrocarbon feed having a final boiling point ranging from about 260° to about 538° C. (500°to 1000° F.).

14. A method for treating gaseous effluent from a hydrocarbon pyrolysis process unit, the method comprising:

(a) passing the gaseous effluent derived from pyrolysis of a feed heavier than naphtha through at least one primary heat exchanger, thereby cooling the gaseous effluent to a temperature above its dew point and generating from saturated steam having a temperature of less than about 288° C. (550° F.), superheated steam having a temperature of at least about 399° C. (750° F.) and a pressure of no greater than about 6310 kPa (900 psig);

(b) passing the gaseous effluent from step (a) through at least one secondary heat exchanger having a heat exchange surface maintained at a temperature such that part of the gaseous effluent condenses to form a liquid coating on said surface, thereby further cooling the gaseous effluent to a temperature at which tar, formed by the pyrolysis process, condenses;

(c) passing the gaseous effluent from step (b) through at least one knock-out drum, where the condensed tar separates from the gaseous effluent; and then (d) reducing the temperature of the gaseous effluent to less than about 100° C. (212° F.);

said method being carried out in the absence of direct quenching.

15. The method of claim 14, wherein said gaseous effluent derived from said pyrolysis has a temperature ranging from about 704° to about 927° C. (1300° to 1700° F.), and said steam is superheated in said primary heat exchanger to a temperature ranging from about 399° to about 704° C. (750° to 1300° F.) and a pressure ranging from about 2170 to about 6310 kPa (about 300 to about 900 psig).

16. The method of claim 14, wherein said steam is superheated to a temperature ranging from about 482° to about 538° C. (900° to 1000° F.) and a pressure ranging from about 3206 to about 5275 kPa (450 to 750 psig).

17. The method of claim 14, wherein said heat exchange surface is maintained at a temperature below that at which tar condenses.

18. The method of claim 14, wherein said heat exchange surface is maintained at a temperature below about 316° C. (600° F.).

19. The method of claim 14, wherein said heat exchange surface is disposed substantially vertically and is maintained at said temperature by indirect heat exchange with a heat transfer medium which flows downwards through said at least one secondary heat exchanger.

20. The method of claim 14, wherein said heat exchange surface is maintained at said temperature by indirect heat exchange with water and the water heated in the at least one secondary heat exchanger is used as a heat exchange medium in the primary heat exchanger.

21. The method of claim 14, wherein (d) reduces the temperature of the gaseous effluent to about 20° C. to about 50° C. (68° to about 122° F.).

22. The method of claim 14, wherein (d) also includes condensing and separating a pyrolysis gasoline fraction from the effluent.

23. The method of claim 14, wherein said gaseous effluent is produced by pyrolysis of a hydrocarbon feed boiling at a temperature greater than about 180° C. (356° F.).

24. Hydrocarbon cracking apparatus comprising:

(a) a reactor for pyrolyzing a hydrocarbon feedstock, the reactor having an outlet through which gaseous pyrolysis effluent can exit the reactor;

(b) at least one primary heat exchanger connected to and downstream of the reactor outlet for cooling the gaseous effluent in the absence of direct quench, said primary heat exchanger comprising: (i) a heat transfer exchange medium inlet communicating with a source of saturated steam having a temperature ranging from about 214° to about 277° C. (417° to 530° F.), and a pressure of less than about 6310 kPa (900psig) and (ii) a heat transfer exchange medium outlet providing superheated steam having a temperature of at least about 3990C (7500F) and a pressure of no greater than about 6310 kPa (900 psig);

(c) at least one secondary heat exchanger comprising: (i) a heat transfer exchange medium inlet communicating with a source of water at a temperature of less than about 260° C. (500° F) and a pressure of less than about 7000kPa (1000 psig) and (ii) a heat transfer exchange medium outlet providing saturated steam having a temperature ranging from about 232° to about 288° C. (about 450° to about 550° F.), and a pressure of less than about 6310 kPa (900psig), said secondary heat exchanger being connected to and downstream of the at least one primary heat exchanger for further cooling said gaseous effluent in the absence of direct quench, wherein said at least one secondary heat exchanger includes an inlet for said gaseous effluent and said inlet is thermally insulated from said heat exchange surface to maintain said inlet at a temperature above that at which tar in said gaseous effluent condenses, said at least one secondary heat exchanger having a heat exchange surface which is maintained, in use, at a temperature such that part of the gaseous effluent condenses to form in situ a liquid coating on said surface, thereby cooling the remainder of the gaseous effluent to a temperature at which tar, formed during pyrolysis, condenses; and (d) means for separating condensed tar from the gaseous effluent.

25. The apparatus of claim 24 wherein said heat exchange surface is disposed substantially vertically and is maintained at said temperature by indirect heat exchange with a heat transfer medium which flows downwards through said at least one secondary heat exchanger.

26. The apparatus of claim 24, wherein said at least one secondary heat exchanger is selected from the group consisting of tube-in-shell heat exchanger and tube-in-tube heat exchanger.

27. The apparatus of claim 24 and further including a decoking system having an inlet for a decoking medium and an outlet for coke, wherein said primary and secondary heat exchangers can be connected to said decoking system such that said decoking medium passes through said at least one primary heat exchanger and then said at least one secondary heat exchanger before flowing to said outlet.

28. The apparatus of claim 27, wherein said primary and secondary heat exchangers comprise heat exchange tubes and the or each heat exchange tube of the secondary heat exchanger has an internal diameter equal to or greater than that of the or each heat exchange tube of the primary heat exchanger.

29. The apparatus of claim 24, wherein said means (d) is a tar knock-out drum.

30. The apparatus of claim 24 wherein the heat transfer exchange medium inlet of (b) is in communication with the heat transfer exchange medium outlet of (c).

* * * * *